United States Patent [19]

Riese et al.

[11] 4,138,965

[45] Feb. 13, 1979

[54] APPARATUS FOR DELIVERING METERED AMOUNTS OF VARNISH TO THE SURFACE OF A CAN, OR THE LIKE

[75] Inventors: John J. Riese, Appleton, Wis.; Albert H. Burton, Ridgefield, Conn.; Leonard M. Moore, Goshen, N.Y.

[73] Assignee: American Can Company, Greenwich, Conn.

[21] Appl. No.: 851,371

[22] Filed: Nov. 14, 1977

[51] Int. Cl.[2] ..... B05C 1/02

[52] U.S. Cl. ..... 118/203; 118/230; 118/232; 118/262

[58] Field of Search ..... 118/203, 262, 232, 230; 29/132

[56] References Cited

U.S. PATENT DOCUMENTS

| | | | |
|---|---|---|---|
| 2,293,691 | 8/1942 | Harrigan | 118/262 X |
| 2,329,263 | 9/1943 | Gladfeljer et al. | 118/262 X |
| 2,393,529 | 1/1946 | Harrigan | 118/262 |
| 3,155,541 | 11/1964 | Jackson | 118/262 X |
| 3,245,377 | 4/1966 | Gettel | 118/203 X |
| 3,855,967 | 12/1974 | Skrypek et al. | 118/262 X |
| 3,950,833 | 4/1976 | Adams | 29/132 |

*Primary Examiner*—John McIntosh
*Attorney, Agent, or Firm*—Robert P. Auber; Ira S. Dorman; Ernest L. Brown

[57] ABSTRACT

Apparatus for delivering metered amounts of varnish to the surface of a metal can, or the like. Varnish is delivered to a metering roll having recesses in its surface and a doctor blade to scrape off excessage. The varnish in the recesses of the metering roll is delivered to a varnishing roll in continuously metered amounts, and it is delivered by the varnishing roll to the surface of a can, or the like. Remaining varnish is removed from the varnishing roll by a second doctor blade so that substantially no varnish is present on the varnishing roll at the points of delivery of metered varnish to such varnishing roll.

4 Claims, 2 Drawing Figures

APPARATUS FOR DELIVERING METERED AMOUNTS OF VARNISH TO THE SURFACE OF A CAN, OR THE LIKE

BACKGROUND OF THE INVENTION

To coat a steel can or the like with varnish, typically three rolls are used. The first two rolls, which are usually of the same diameter, are usually of steel and are separated by a very small amount. Varnish or other similar coating is applied to the space between the rolls. The varnish passes through the space and forms a film on the two rolls. The third or varnishing roll typically has a resilient surface made of composition material. The second and third rolls are in contact, and varnish is applied by the second roll onto the third roll, which then applies the varnish onto the can which is in contact with the third roll.

BRIEF DESCRIPTION OF THE INVENTION

In accordance with this invention, typically the second roll has a hard surface which is engraved in a manner similar to engraving a gravure cylinder. That is, the surface of the roll has a plurality of recesses thereon. The recesses may be etched on a metal surface such as copper, chrome or steel. It is also possible to etch them on plastics or glass. Typically the recesses are etched in copper, and the surface is then plated with chrome. The second roll is spaced from the first roll, and varnish or other similar coating is transferred from the space between the first two rolls onto the surface of the first and second rolls. The varnish fills the recesses of the second roll. The recesses act as varnish wells, and excess varnish is scraped off of the second roll by a doctor blade ahead of the points where the second roll comes in contact with a third resilent roll having a composition surface. The amount of transferred varnish depends partly upon the force of the doctor blade against the second roll. When the second roll contacts the third or composition roll, a controlled amount of the varnish or similar material in the wells is transferred from the wells in the second roll onto the surface of the third or composition roll. The varnish spreads out to cover the surface of the third roll. To ensure that only the correct amount of varnish is delivered to the composition or third roll, a second doctor blade scrapes any remaining varnish off the third or composition roll ahead of the point where the metered amount of varnish is transferred from the second to the third roll. In this way, no buildup of varnish occurs at the points of contact between the second and third rolls. The varnish delivered to the third or composition roll is then delivered to the surface of the cans in metered amounts by a rolling contact between the cans and the third roll.

It is therefore an object of this invention to apply a metered amount of varnish or similar material to the surface of cans and the like.

BRIEF DESCRIPTION OF THE DRAWINGS

Other objects will become apparent from the following description taken in connection with the accompanying drawings in which.

DETAILED DESCRIPTION OF THE INVENTION

Figure 1:
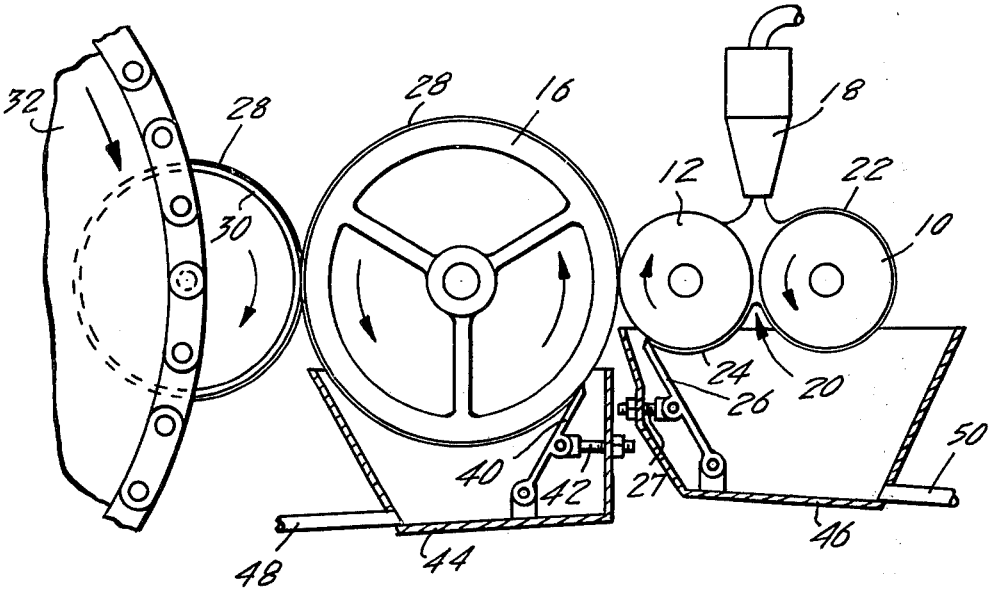
FIG. 1 is a side view of the apparatus of the invention with portions shown in section.
Figure 2:
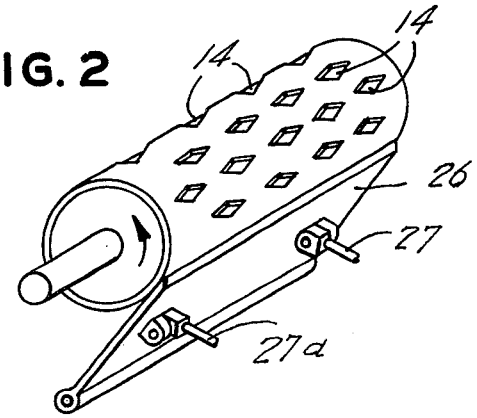
FIG. 2 is a profile view of the surface of a typical second roll showing a typical engraved design of varnish wells on the surface thereof and means for adjusting a doctor blade.

In the figures, a first roll 10 is preferably made of steel such as stainless steel. Spaced apart from the roll 10 is a second roll 12 which maybe made of steel with or without a coating of copper, chrome or similar engravable material. Plastics or glass may also be used. The roll has an engraved surface as shown in FIG. 2. The recesses 14 on the surface of roll 12 form varnish wells for carrying varnish or other coating material, as described hereinafter. The roll 12 is in contact with a composition roll 16, which may be, for example, polyurethane, rubber, buna-N rubber, or a composite of polypropylene and polyethylene which is sold under the trademark Nordel. Other resilient surfaces which do not react chemically with the varnish may be used. Typically, the rolls 10, 12, and 16 are driven, mounted and aligned from one end by means (not shown).

Alternatively, roll 10 may be replaced by a spreading mechanism (not shown) for spreading the varnish onto the engraved roll 12.

A nozzle 18 receives varnish or similar coating material from a source (not shown), and the varnish may be under pressure. The nozzle 18 delivers varnish to space 20 between the rolls 10 and 12. The varnish spreads over the rolls 10 and 12 as shown by the coatings 22 and 24.

A first doctor blade 26 is pressed by screws 27 and **27*a* or hydraulic cylinders (not shown) against the surface of the roll 12 under controlled pressure to remove predetermined amounts of varnish from the roll 12. Thus a metered amount of varnish is delivered per revolution of the rolls 12 and 16. The varnish delivered from roll 12 to roll 16, spreads and forms a film 28** on the surface thereof.

The pressure of the first doctor blade 26 against the surface of roll 12 may be used as partial control of the rate of delivery of varnish to roll 16. Increasing the pressure causes the blade to remove more varnish from the surface and wells 14 of roll 12, and the rate of delivery of varnish to roll 16 is thus reduced. Decreasing blade pressure will cause more varnish to be delivered to roll 16. By varying the pressure along the first doctor blade 26, the rate of delivery of varnish to roll 16 can be varied in different zones along the roll. Thus more, or less, varnish may be applied to corresponding zones of can 30 by applying different pressures to different zones along doctor blade 26 by adjusting pressure screws 27 and **27*a***. Additional pressure screws may be used if desired. Alternatively, hydraulic or pneumatic cylinders (not shown) may be used as force means.

Cans 30, to be varnished, are moved into position to contact and turn with the roll 16. The moving mechanism, only a portion of which is shown at 32, holds the can 30 in contact with the roll 16 for a predetermined period of time to allow the spread varnish 28 to be transferred from the roll 16 to the surface of the can 30.

Some varnish may remain on the surface of the roll 16 after the roll 16 passes the point of delivery of varnish to the can 30. A second doctor blade 40 removes the remaining varnish from the surface of the roll 16 so that there will be no buildup on the roll 16. The doctor blade 40 is pressed into position against the roll 16 by the screw means 42. Reservoirs 44 and 46 are positioned to receive any dripping varnish, and they may have drains 48 and 50 delivering that varnish back to a common point.

Note that when the moving mechanism 32 is moving, the rolls 10, 12 and 16 continue to turn, and varnish continues to be delivered to the surface of the roll 16. However, no varnish is being delivered to cans 30, and the doctor blade 40 removes all that varnish before it gets back to the point of contact between the rolls 12 and 16.

The wells 14 may be of any shape or size. The amount of varnish delivered depends upon the volume and distribution of the wells, the force of the doctor blade 26, the speed of the rolls, and the physical properties of the varnish. The wells 14 need not be of the same shape. The shown rhombic shape is exemplary only. Usually the wells are uniformly distributed around the roller 12 so that the rate of flow of varnish does not vary substantially with roll position.

Sometimes it is desired to apply more varnish to particular zones of the can. To that end, the volume of the wells in those zones may be increased by making them larger or deeper or by changing their shape. Thus, there is no requirement of uniform distribution, shape or size of the wells along the roll 12.

Thus, the roll 12 precisely measures the amount of varnish delivered to roll 16, and the second doctor blade 40 ensures that there is no buildup on the roll 16 so that the amount of varnish delivered to the can 30 is precisely determined and metered.

Although the invention has been described in detail above, it is not intended that the invention should be limited by that description, but only by that description taken together with the words of the following claims.

We claim:

1. In combination:

first, second and third rolls having substantially parallel axes;

said first and second rolls being spaced apart by a predetermined space;

means for delivering varnish into said space;

said second roll having varnish wells distributed over the surface thereof;

said third roll having a resilient varnishing surface and being in contact with said second roll to receive varnish from said second roll; and first and second doctor blades circumferentially positioned to remove varnish from said second and third rolls, respectively, ahead of the points of contact between said second and third rolls, said second blade removing substantially all varnish from said third roll; and means for rolling cans against said third roll to receive a precise amount of varnish therefrom.

2. The combination of claim 1 wherein said wells are substantially of the same volume but non-uniformly distributed along the length of said second roll and substantially uniformly distributed about its circumference.

3. The combination of claim 1 wherein the volume of said wells is non-uniform along the length of said second roller and substantially uniform about its circumference.

4. The combination of claim 1 wherein the pressure between said first doctor blade and said second roll is used to control the rate of application of varnish to said third roll from said second roll and is non-uniform along the length of said first doctor blade.

* * * * *